US012590439B2

(12) United States Patent
Matsumoto et al.

(10) Patent No.: US 12,590,439 B2
(45) Date of Patent: Mar. 31, 2026

(54) WORKING VEHICLE

(71) Applicant: TAKEUCHI MFG. CO., LTD., Hanishina-gun (JP)

(72) Inventors: Tetsuya Matsumoto, Hanishina-gun (JP); Hidaka Oyama, Hanishina-gun (JP); Kengo Kumeuchi, Hanishina-gun (JP)

(73) Assignee: TAKEUCHI MFG. CO., LTD., Hanishina-gun (JP)

( * ) Notice: Subject to any disclaimer, the term of this patent is extended or adjusted under 35 U.S.C. 154(b) by 330 days.

(21) Appl. No.: 18/423,407

(22) Filed: Jan. 26, 2024

(65) Prior Publication Data

US 2024/0410130 A1 Dec. 12, 2024

(30) Foreign Application Priority Data

Jun. 12, 2023 (JP) ..... 2023-096464

(51) Int. Cl.
*E02F 9/08* (2006.01)

(52) U.S. Cl.
CPC ..... *E02F 9/0833* (2013.01); *E02F 9/0858* (2013.01)

(58) Field of Classification Search
CPC ..... E02F 9/0833; E02F 9/0858
See application file for complete search history.

(56) References Cited

U.S. PATENT DOCUMENTS

| | | | | |
|---|---|---|---|---|
| 11,427,450 | B2 * | 8/2022 | Stilwell | B66F 9/07572 |
| 2006/0061178 | A1 * | 3/2006 | Billger | B66F 9/07545 297/344.21 |
| 2014/0021781 | A1 * | 1/2014 | Satake | E02F 9/0866 307/9.1 |
| 2015/0225926 | A1 * | 8/2015 | Hutchinson | E02F 9/2075 414/685 |

(Continued)

FOREIGN PATENT DOCUMENTS

| | | | |
|---|---|---|---|
| JP | 2012-209467 | A | 10/2012 |
| JP | 2018-168635 | A | 11/2018 |

(Continued)

OTHER PUBLICATIONS

Extended Supplementary European Search Report dated Jul. 22, 2024, issued in counterpart Application No. 24154727.2. (6 pages).

(Continued)

*Primary Examiner* — Erez Gurari
(74) *Attorney, Agent, or Firm* — WHDA, LLP

(57) ABSTRACT

Maintenance of components to be maintained is facilitated in a working vehicle equipped with an electric motor as a driving source of a working unit. A working vehicle 1 includes an upper slewing body, a lower traveling body, working units that is operated by hydraulic pressure, an electric motor for driving the working units, a battery pack for supplying power for driving the electric motor: a battery pack compartment for installing the battery pack: and a battery cover that is openable and covers an opening in the battery pack compartment. In the battery pack, at least a (Continued)

battery management unit board, a cell management unit board, a charging fuse, and a service plug are disposed as the components to be maintained at positions within a reach of a maintenance worker's hand through the opening.

9 Claims, 5 Drawing Sheets

(56) References Cited

U.S. PATENT DOCUMENTS

| | | | | |
|---|---|---|---|---|
| 2021/0254305 | A1* | 8/2021 | Kihara | E02F 9/207 |
| 2021/0270004 | A1* | 9/2021 | Durkin | E02F 9/2271 |
| 2022/0025610 | A1* | 1/2022 | Springer | E02F 9/0833 |
| 2023/0039973 | A1* | 2/2023 | Kumeuchi | E02F 3/325 |
| 2023/0417019 | A1* | 12/2023 | Kitahara | E02F 9/207 |
| 2024/0026641 | A1* | 1/2024 | Morikawa | E02F 9/0808 |
| 2024/0191476 | A1* | 6/2024 | Roehlk | E02F 9/0841 |
| 2025/0019931 | A1* | 1/2025 | Ito | B60L 50/60 |
| 2025/0250769 | A1* | 8/2025 | Kitahara | E02F 9/0858 |
| 2025/0289332 | A1* | 9/2025 | Kanai | B60L 53/16 |

FOREIGN PATENT DOCUMENTS

| | | | |
|---|---|---|---|
| JP | 2020-45631 | A | 3/2020 |
| JP | 2020-68593 | A | 4/2020 |
| JP | 2023-23324 | A | 2/2023 |

OTHER PUBLICATIONS

Office Action dated Mar. 25, 2025, issued in counterpart JP Application No. 2023-096464, with English translation. (8 pages).

* cited by examiner

WORKING VEHICLE

CROSS-REFERENCE TO RELATED APPLICATION

This application is based upon and claims the benefit of priority of the prior Japanese Patent Application No. P2023-096464, filed on Jun. 12, 2023, and the entire contents of which are incorporated herein by reference.

TECHNICAL FIELD

The present invention relates to a working vehicle including a working unit that is operated by hydraulic pressure and an electric motor that is a driving source for the working unit.

BACKGROUND ART

Hydraulic excavators, track loaders, and the like that are configured with a lower travelling body, which includes crawlers or wheels, and an upper slewing body on which a working unit that is operated by hydraulic pressure is mounted are conventionally known.

Recently, a working vehicle equipped with an electric motor instead of a conventional engine as the driving source of the working unit is under development (refer to PTL 1: Japanese Laid-open Patent Publication No. 2023-23324).

SUMMARY OF INVENTION

Technical Problem

As exemplified in Patent Document 1, a working vehicle equipped with an electric motor as a driving source of the working unit is provided with a battery management unit board, a cell management unit board, a charging fuse, a main fuse, a contactor, a service plug, and the like as electrical and control system components that require regular or irregular maintenance (more specifically, replacement, inspection, and the like). In this application, such components may be referred to simply as "components to be maintained".

Here, the working vehicle exemplified in Patent Document 1 has an example configuration where maintenance of the battery management unit board, the cell management unit board, and the like is performed by opening the cover of a battery pack compartment (or simply "battery cover") provided at the rear of the upper slewing body. On the other hand, maintenance is performed on a charging fuse, a service plug, and the like, by sliding forward the seat in the cab provided in the center of the upper slewing body, folding down the back rest, and then opening the maintenance cover provided in the exposed floor plate. In this way, there has been the annoyance that the cover that needs to be opened will differ depending on the maintained component. In particular, opening a maintenance cover in the center of the upper slewing body has involved troublesome work that takes time and effort. There have also been components that cannot be maintained (or replaced) without removing the large battery pack from the upper slewing body.

Solution to Problem

The present invention was conceived in view of the situation described above and has an object of providing a working vehicle that is equipped with an electric motor as a driving source for the working unit and facilitates maintenance of the components to be maintained.

The present invention solves the above problem by using the configuration described below.

A working vehicle according to an aspect of the present disclosure includes an upper slewing body, a lower traveling body, a working unit that is operated by hydraulic pressure, and an electric motor as a driving source for the working unit, the working vehicle further including: a battery pack including a battery and a battery management system for supplying power for driving the electric motor; a battery pack compartment in which the battery pack is installed; and a battery cover that is openable and closeable and covers an opening in the battery pack compartment, wherein at least a battery management unit board, a cell management unit board, a charging fuse, and a service plug of the battery pack are disposed as the components to be maintained at positions within a reach of a maintenance worker's hand through the opening.

According to the above configuration, maintenance can be performed extremely easily and in a short time on the components to be maintained of the electrical and control systems without exposing the floor plate or removing the battery pack from the upper slewing body as with a conventional working vehicle.

It is also preferable for the battery pack to include, on an opening-side surface thereof, an inlet to which an external power cable for charging the battery is connected; and for performing maintenance on predetermined components out of the components to be maintained, a first maintenance opening and a first maintenance cover that is openable and closeable and covers the first maintenance opening, a second maintenance opening and a second maintenance cover that is openable and closeable and covers the second maintenance opening, and a third maintenance opening and a third maintenance cover that is openable and closeable and covers the third maintenance opening.

It is also preferable for the predetermined components on which maintenance is performed via the first maintenance opening by opening the first maintenance cover to be components with a relatively high average maintenance frequency and include at least the battery management unit board, and for the predetermined components on which maintenance is performed via the second maintenance opening by opening the second maintenance cover to be components with a relatively medium average maintenance frequency and include at least the charging fuse, and for the predetermined components on which maintenance is performed via the third maintenance opening by opening the third maintenance cover to be components with a relatively low average maintenance frequency and include at least the cell management unit board.

It is also preferable for the battery pack to have the first maintenance opening formed in a plate surface of the second maintenance cover, the first maintenance cover removably fixed to the plate surface of the second maintenance cover, and the third maintenance cover disposed at a position that cannot be opened unless a counterweight fixed to the upper slewing body is removed.

Also, out of the components to be maintained, the service plug is preferably disposed at a position that is adjacent to the inlet in a left-right direction or an up-down direction.

Advantageous Effects of Invention

According to the present invention, it is possible to improve the ease of maintenance of the components to be maintained in a working vehicle equipped with an electric motor as a driving source for a working unit.

DESCRIPTION OF EMBODIMENTS

Figure 1:
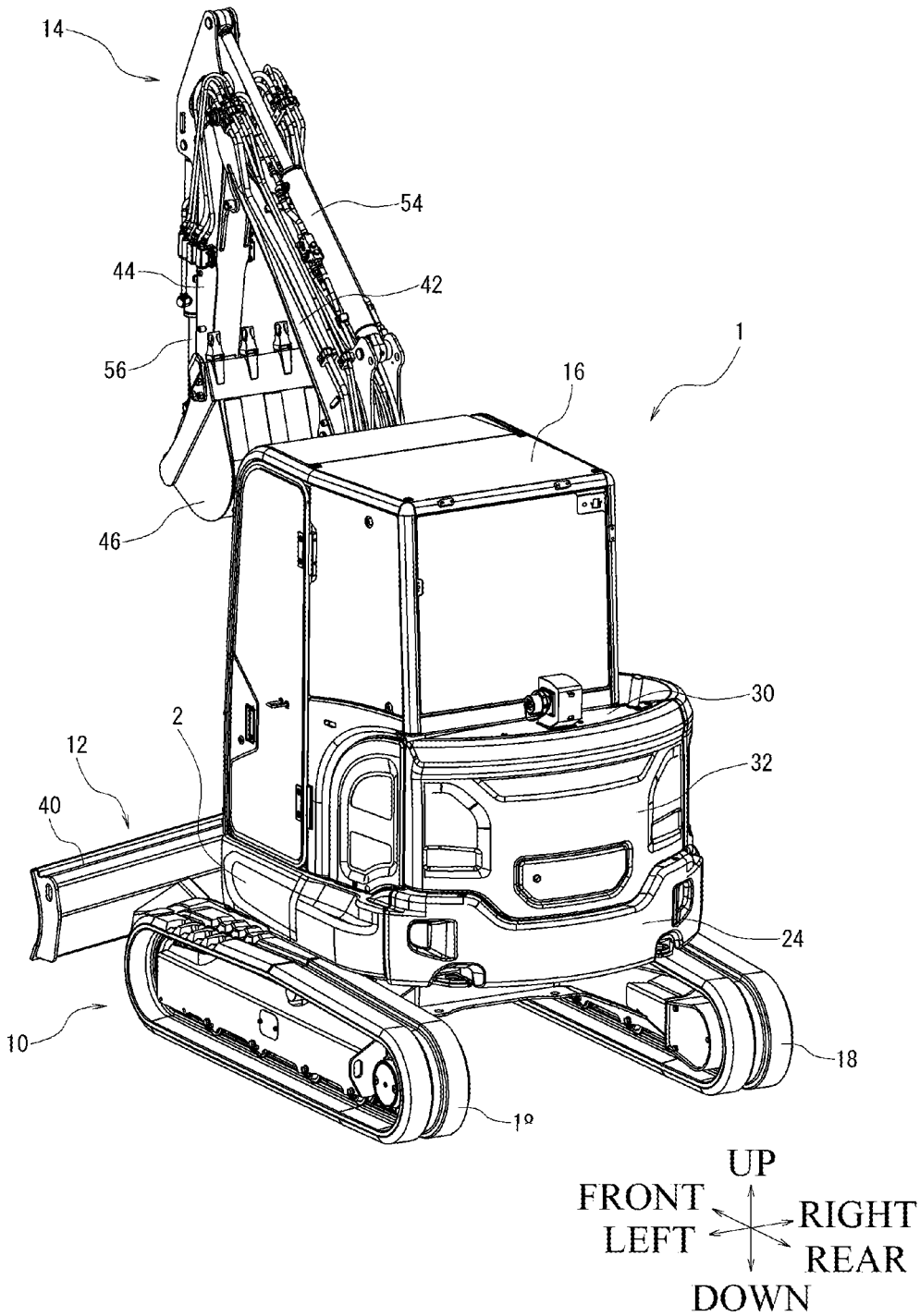
FIG. 1 is a perspective view illustrating an example of a working vehicle according to an embodiment of the present invention.
Figure 2:
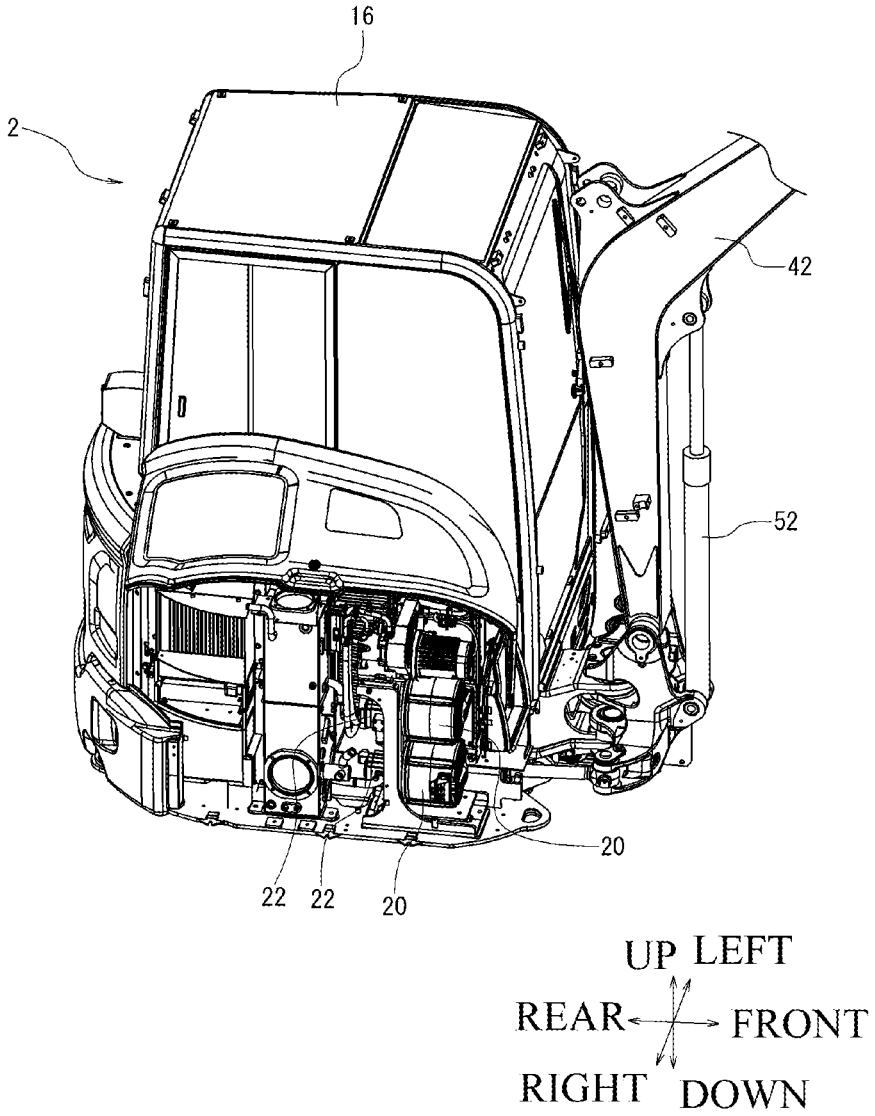
FIG. 2 is a perspective view illustrating an example of an upper slewing body of the working vehicle illustrated in FIG. 1.
Figure 3:
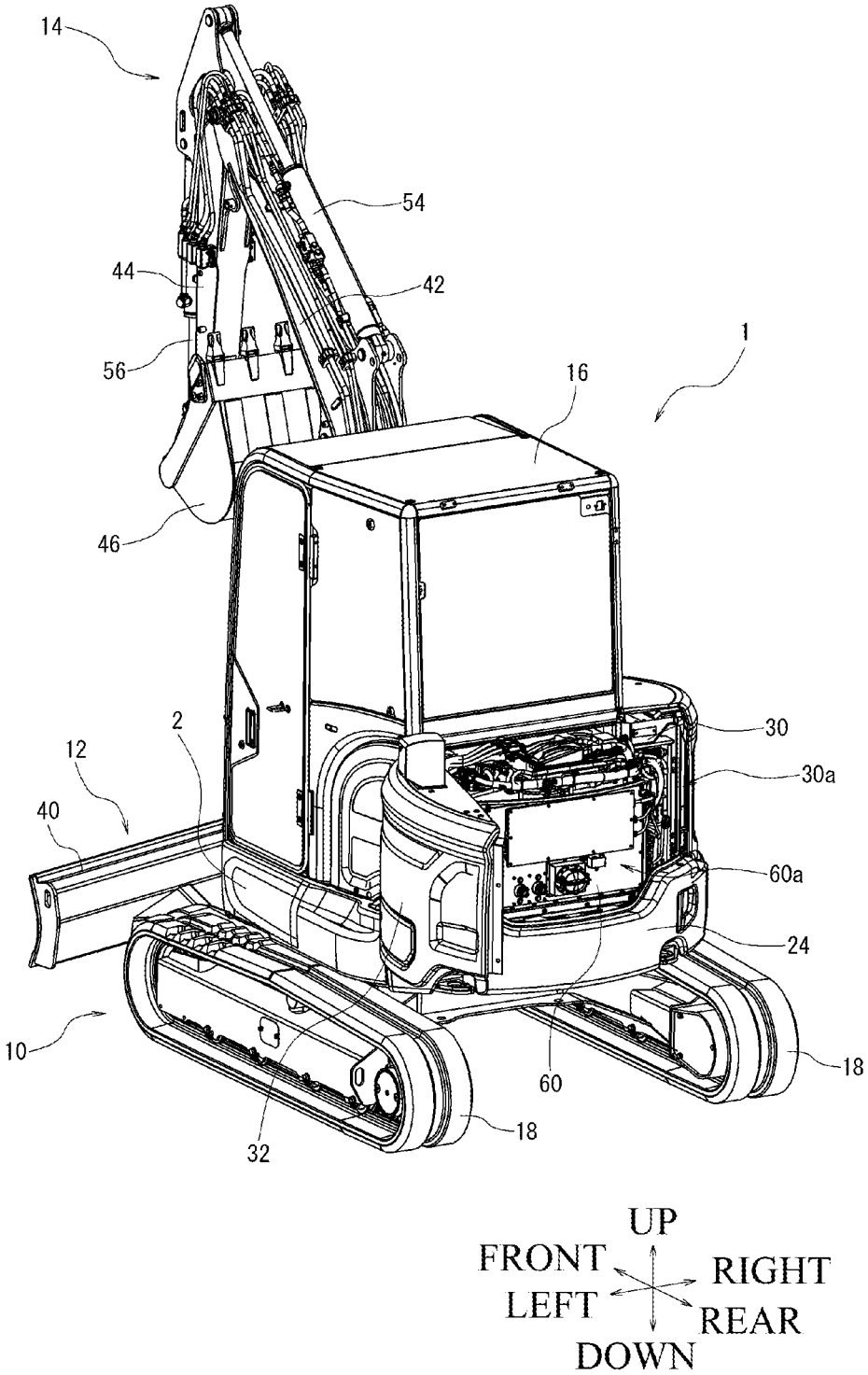
FIG. 3 is a perspective view illustrating an example of a battery pack compartment (in a state where the battery cover has been opened) of the working vehicle illustrated in FIG. 1.
Figure 4:
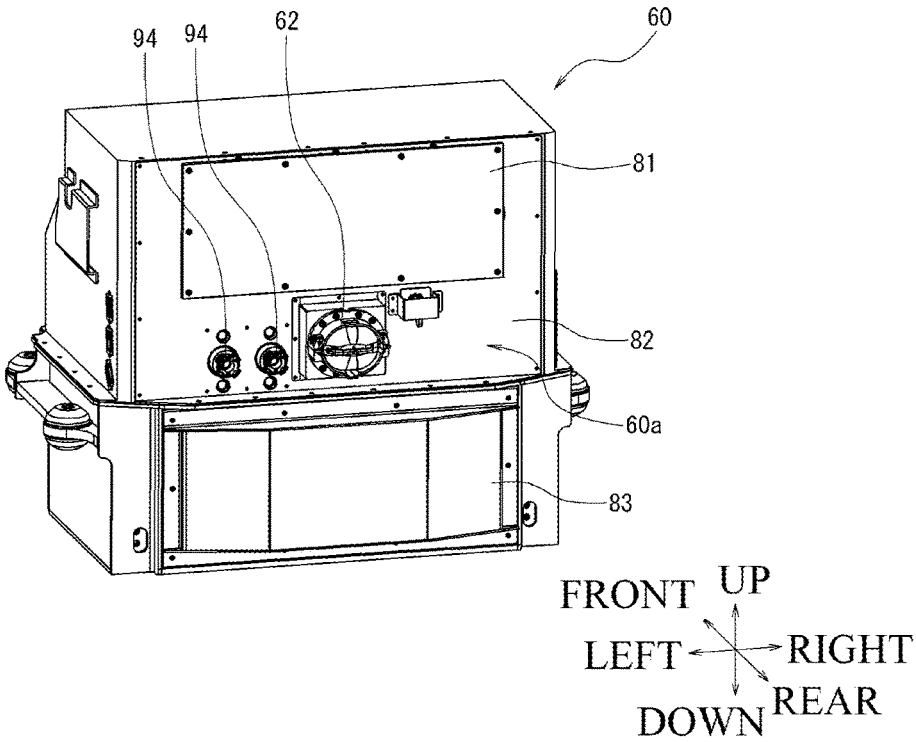
FIG. 4 is a perspective view illustrating a battery pack of a working vehicle illustrated in FIG. 1.
Figure 5:
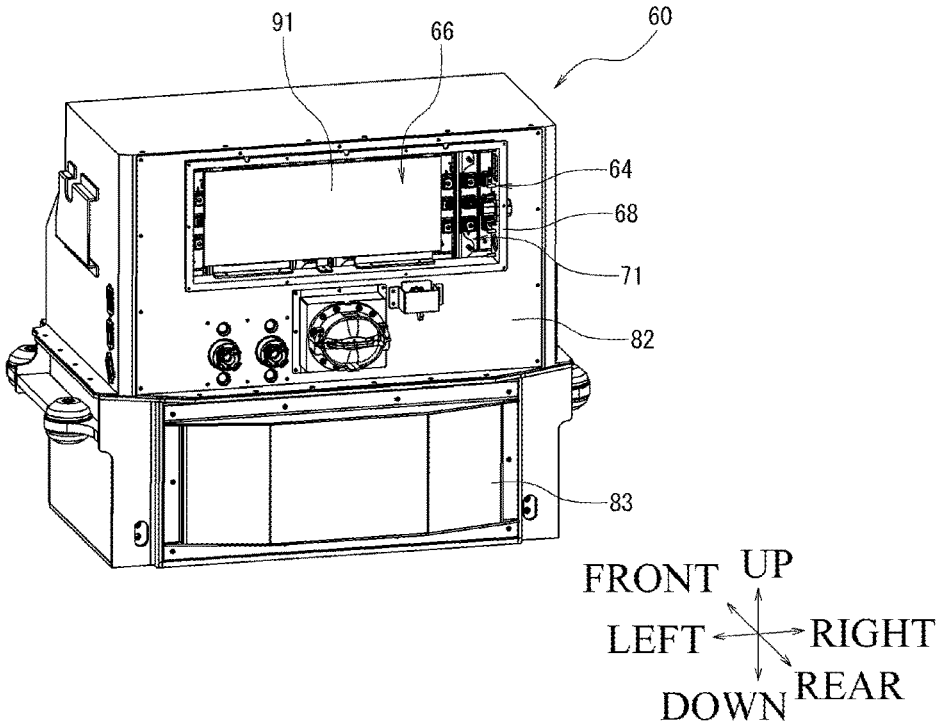
FIG. 5 is a perspective view illustrating one example of a first maintenance opening of the battery pack illustrated in FIG. 4 (in a state where the first maintenance cover has been opened).
Figure 6:
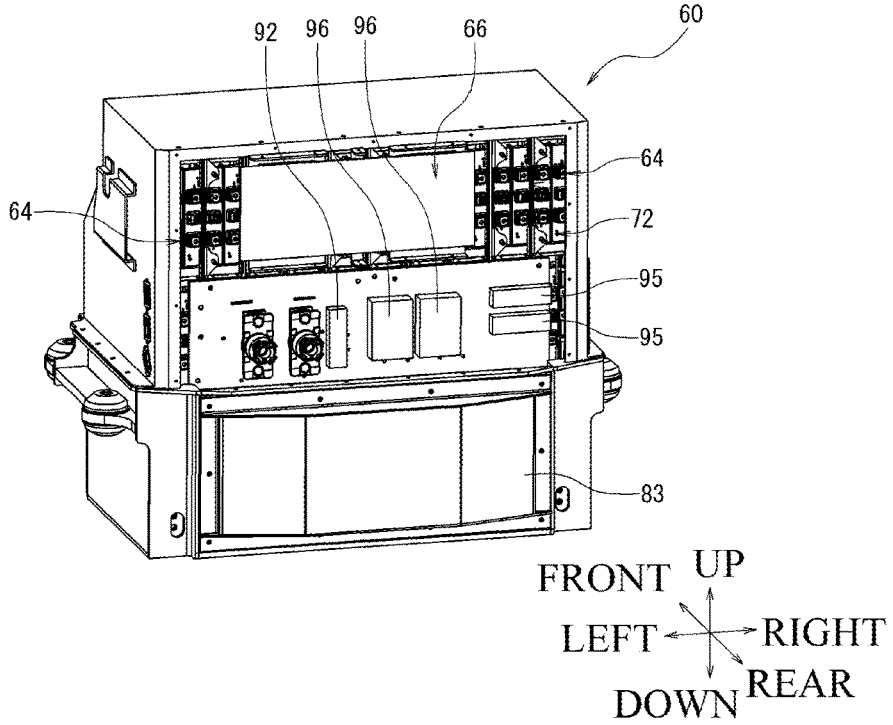
FIG. 6 is a perspective view illustrating one example of a second maintenance opening of the battery pack illustrated in FIG. 4 (in a state where the second maintenance cover has been opened).
Figure 7:
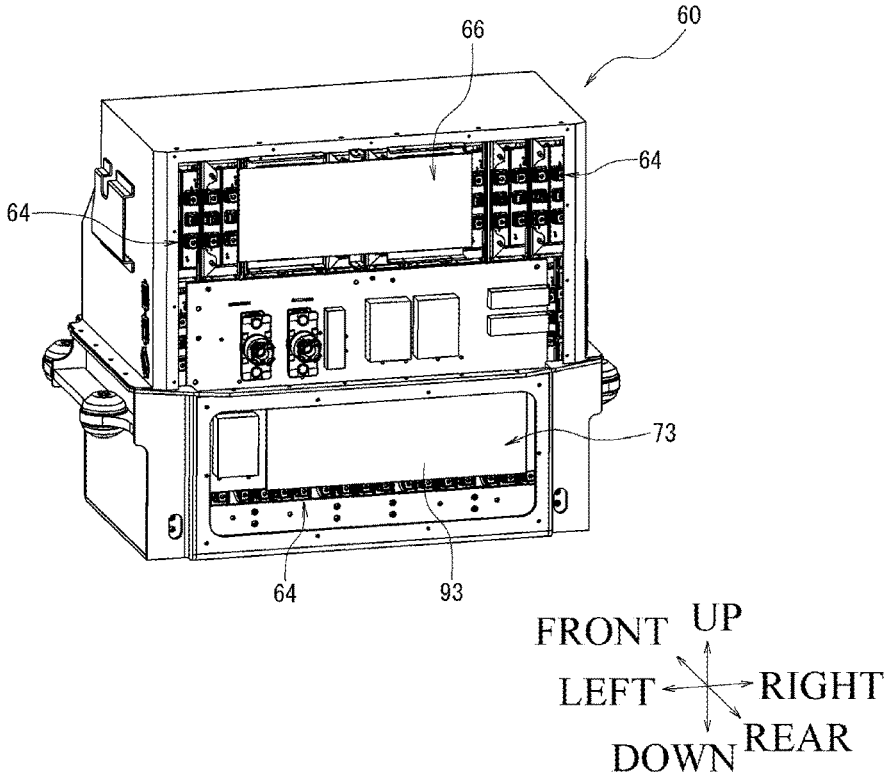
FIG. 7 is a perspective view illustrating one example of a third maintenance opening of the battery pack illustrated in FIG. 4 (in a state where the third maintenance cover has been opened).

Hereinafter, embodiments of the present invention will be described in detail with reference to the drawings. FIG. 1 is a schematic diagram (that is, a perspective view from above a left-rear portion) depicting one example of a working vehicle 1 according to the present embodiment. FIG. 2 is a perspective view (that is, a perspective view from above the right-front portion) depicting one example of an upper slewing body 2 of the working vehicle 1 depicted in FIG. 1. FIG. 3 is a perspective view (that is, a perspective view from above the left-rear portion) depicting one example of a battery pack compartment 30 (with a battery cover 32 opened) of the working vehicle 1 depicted in FIG. 1. FIG. 4 is a perspective view (that is, a perspective view from the same direction as in FIG. 3) depicting one example of a battery pack 60 of the working vehicle 1 depicted in FIG. 1. Note that for ease of explanation, arrows may indicate up and down, front and back, and left and right directions in the drawings. In addition, members with the same function are denoted by the same reference signs and may not be repeatedly described.

The overall configuration of the working vehicle 1 will be described first. A hydraulic excavator will be described as an example of the working vehicle 1. However, the working vehicle 1 is not limited to a hydraulic excavator.

As illustrated in FIG. 1, the working vehicle 1 includes the upper slewing body 2. The working vehicle 1 also includes a lower travelling body 10 that travels. The working vehicle 1 is also equipped with working units 12 and 14 that is operated by hydraulic pressure (that is, hydraulic oil at a predetermined pressure). The working vehicle 1 is also equipped with a cab 16 in which an operator rides and is provided with an operating units for operations relating to travelling and work.

One example of the lower travelling body 10 includes a pair of left and right crawlers 18. However, the lower travelling body 10 is not limited to the crawlers 18, and as another example, the working vehicle 1 may be configured with wheels (not illustrated) in place of the crawlers 18. The crawlers 18 are driven by a hydraulic motor for traveling (not illustrated).

A blade 40 is provided as one example of the working unit 12. The blade 40 is attached to the lower travelling body 10 so as to be capable of swinging upward and downward (such directions include forward and rearward components). The blade 40 is driven by a hydraulic cylinder (or "blade cylinder") (not illustrated). However, the working unit 12 is not limited to the above configuration.

As one example of the working unit 14, a boom 42, an arm 44, and an attachment (in the present embodiment, a bucket) 46 are provided. However, the attachment 46 is not limited to a bucket. The boom 42 is attached to the upper slewing body 2 so as to be capable of swinging upward and downward (such directions include forward and rearward components) (note that a boom bracket may be provided between the upper slewing body 2 and the boom 42 or may be omitted). The arm 44 is attached to the boom 42 so as to be capable of swinging upward and downward (such directions include forward and rearward components). The attachment 46 is attached to the arm 44 so as to be capable of swinging upward and downward (such directions include forward and rearward components). The boom 42 is driven by a hydraulic cylinder (or "boom cylinder") 52. The arm 44 is driven by a hydraulic cylinder (or "arm cylinder") 54. The attachment 46 is driven by a hydraulic cylinder (or "bucket cylinder") 56. However, the working unit 14 is not limited to the above configuration.

As depicted in FIG. 2, the working vehicle 1 includes, as a driving mechanism for driving the hydraulic motor for traveling, described above, and the hydraulic cylinders, a driving source 20, a hydraulic pump 22 driven by the driving source 20, control valves, and the like. One or a plurality of hydraulic pumps 22 are provided in keeping with the configurations, loads, and the like of the working units 12 and 14 and the lower travelling body 10.

As an overview of operations, the control valves are actuated by the operator operating the operation units to exercise control that supplies hydraulic oil at a predetermined pressure from the hydraulic pump 22 to the hydraulic motor for traveling and the hydraulic cylinders. By doing so, it is possible for the lower travelling body 10 to travel and for the working units 12, 14 to perform work.

Note that in the present embodiment, the working vehicle 1 includes an electric motor as the driving source 20 described above. One or a plurality of electric motors that construct the driving source 20 are provided depending on the number, rated output power, and the like of the hydraulic pump 22 described above. Note that as another example of the driving source 20, the driving source 20 may be configured to use an engine in addition to an electric motor (not illustrated).

As depicted in FIG. 3, the working vehicle 1 includes a battery pack compartment 30 to the rear of the upper slewing body 2 and a battery cover 32 that is openable and covers an opening 30*a* of the battery pack compartment 30. A battery pack 60 that supplies electric power for driving the electric motor 20 is installed in the battery pack compartment 30.

As depicted in FIG. 4 to FIG. 7, the battery pack 60 includes an inlet 62 to which an external power cable is detachably connected. The battery pack 60 also includes a battery (as one example, a lithium-ion rechargeable battery) 64 that stores power supplied from an external power source or an on-board charger (not illustrated). The battery pack 60 also includes a battery management system 66 that controls charging of and supplying of power by the battery 64.

In addition, the battery pack 60 includes a battery management unit board 91, a cell management unit board 93, a charging fuse 92, a main fuse 95, contactors 96, service plugs 94, and the like as the components to be maintained (which can also be referred to as "maintenance-expected components") of an electrical and control system that require (or are imagined to require) regular (as one specific example, when a specified time has passed) or irregular (as one specific example, when a failure has occurred) maintenance (as specific examples, replacement or inspection). These the components to be maintained are components that construct the battery management system 66, components that are incorporated in the charging/discharging circuit of the battery 64, or the like. Note that the expression "service plugs 94" refers to component that turn the charging/discharging circuit of the battery 64 on and off by being inserted or removed.

Here, out of the components to be maintained described above, at least the battery management unit board 91, the cell management unit board 93, the charging fuse 92, and the service plugs 94 can be placed within reach of the maintenance worker's hand inside (i.e., within a suitable distance of) the opening 30*a* in the battery pack compartment 30.

According to the above configuration, it is possible to solve the problem relating to the maintenance of the components to be maintained in conventional working vehicles. That is, all of the components to be maintained described above of the battery pack 60 are disposed within a range that can be accessed by opening the battery cover 32. In particular, there is no need to slide the seat of the cab 16 and fold down the back rest to expose the floor plate. Moreover, it is not necessary to remove the large and heavy battery pack 60 from the upper slewing body 2. Accordingly, the maintenance of the components to be maintained can be performed very easily and in a short period of time, which makes it possible to greatly facilitate maintenance.

In addition, as a characteristic configuration of the present embodiment, the battery pack 60 has the following configuration on a surface 60*a* that faces the opening 30*a* (that is, a surface facing the rear of the upper slewing body 2). In more detail, the inlet 62 described earlier is provided on this surface 60*a*. In addition, a first maintenance opening 71 for performing maintenance on predetermined components to be maintained (described later) and a first maintenance cover 81 that is openable and closeable and covers the first maintenance opening 71 are provided on the surface 60*a* (see FIG. 4 and FIG. 5). A second maintenance opening 72 for performing maintenance on predetermined components to be maintained (described later) and a second maintenance cover 82 that is openable and closeable and covers the second maintenance opening 72 are also provided on the surface 60*a* (see FIG. 5 and FIG. 6). A third maintenance opening 73 for performing maintenance on predetermined components to be maintained (described later) and a third maintenance cover 83 that is openable and closeable and covers the third maintenance opening 73 are also provided on the surface 60*a* (see FIG. 6 and FIG. 7).

Here, the "predetermined components to be maintained" mentioned above are as follows. First, the components to be maintained on which maintenance is performed through the first maintenance opening 71 by opening the first maintenance cover 81 are components with a high relative average maintenance frequency. This includes at least the battery management unit board 91. Next, the components to be maintained on which maintenance is performed through the second maintenance opening 72 by opening the second maintenance cover 82 are components with a medium relative average maintenance frequency. This includes at least the charging fuse 92. Next, the components to be maintained on which maintenance is performed through the third maintenance opening 73 by opening the third maintenance cover 83 are components with a low relative average maintenance frequency. This includes at least the cell management unit board 93.

According to the above configuration, maintenance of components with a high relative average maintenance frequency can be performed from the first maintenance opening 71, which in relative terms is the easiest to access. Maintenance of components with a medium relative maintenance frequency can be performed through the second maintenance opening 72, which in relative terms is the second easiest to access. Maintenance of components with a low relative average maintenance frequency can be performed through the third maintenance opening 73, which in relative terms is the third easiest to access. Note that the ease of access referred to here has the position at which maintenance work is performed and the ease with which the maintenance cover can be attached and detached as indices.

In general, a working vehicle needs to be compactly configured, and it is important to mount various devices on the upper slewing body efficiently in a space-saving arrangement. This means that it is difficult in practice to collectively install all of the components to be maintained of the electrical and control systems exemplified above at a single location. In addition, the frequency at which maintenance is performed on the components to be maintained is not uniform. However, according to the configuration described above, it is possible to dispose a plurality of types of the components to be maintained at suitable positions in consideration of their respective average maintenance frequencies. In other words, the components with a high average maintenance frequency are disposed so that maintenance can be performed more easily. Accordingly, compared with a conventional working vehicle, the ease of maintenance can be significantly improved.

In particular, in the present embodiment, the third maintenance cover 83 is disposed at a position where it cannot be opened unless a counterweight 24 fixed to the upper slewing body 2 is removed. According to normal design concepts, it is preferable to avoid providing a maintenance opening (in this case, the third maintenance opening 73) at a position where maintenance cannot be performed unless the counterweight 24 is removed since this makes maintenance more difficult. However, as described above, by selecting the components with a low average maintenance frequency and disposing the selected components at such position, it is possible to both avoid frequent maintenance and make effective use of the space behind the counterweight 24, which enable space to be saved in the upper slewing body 2.

Also, in the present embodiment, the first maintenance opening 71 is formed in a plate surface of the second maintenance cover 82, with the first maintenance cover 81 detachably fixed to this plate surface. In more detail, a frame 68 that protrudes rearward is provided on the plate surface of the second maintenance cover 82, and the first maintenance cover 81 is fixed so as to cover the front end of this frame 68. According to this configuration, since wiring insertion holes, connectors, and the like (not illustrated) can be provided on the peripheral surfaces of the frame 68, a reduction can be made in the space for laying out wiring around the battery pack 60. However, it is also possible to use a configuration in which the frame body 68 is not provided.

Note that the service plugs 94 is disposed at a position adjacent to the inlet 62 on the left side (or right side, upper side, or lower side). According to this configuration, effective use can be made of the space around the inlet 62 that is provided so as to protrude from the battery pack 60. The service plugs 94 are the components that are removed as a general rule when performing maintenance on the components to be maintained of the electrical and control systems, and can be disposed at a position that can be accessed simply by opening the battery cover 32.

Since other mechanisms for causing the working vehicle 1 according to the present embodiment to travel and perform work are the same as those in a known working vehicle (here, a hydraulic excavator), detailed description thereof is omitted.

As described above, according to the present invention, maintenance can be performed extremely easily and in a short time on the components to be maintained of the electrical and control systems without exposing the floor plate or removing the battery pack from the upper slewing body as with a conventional working vehicle. Accordingly, it is possible to significantly improve the ease of maintenance compared with the conventional art.

The present invention is not limited to the example (a hydraulic excavator) described above. The present invention can be applied in the same way to other working vehicles (as examples, track loaders and tracked dumpers).

What is claimed is:

1. A working vehicle including an upper slewing body, a lower traveling body, a working unit that is operated by hydraulic pressure, and an electric motor as a driving source for the working unit, the working vehicle comprising:

a battery pack including a battery and a battery management system for supplying power for driving the electric motor;

a battery pack compartment in which the battery pack is installed; and a battery cover that is openable and closeable and covers an opening in the battery pack compartment, wherein at least a battery management unit board, a cell management unit board, a charging fuse, and a service plug of the battery pack are disposed as components to be maintained at positions within a reach of a maintenance worker's hand through the opening.

2. The working vehicle according to claim 1, wherein the battery pack includes, on an opening-side surface thereof, an inlet to which an external power cable for charging the battery is connected; and for performing maintenance on predetermined components out of the components to be maintained, a first maintenance opening and a first maintenance cover that is openable and closeable and covers the first maintenance opening, a second maintenance opening and a second maintenance cover that is openable and closeable and covers the second maintenance opening, and a third maintenance opening and a third maintenance cover that is openable and closeable and covers the third maintenance opening.

3. The working vehicle according to claim 2, wherein the predetermined components on which maintenance is performed via the first maintenance opening by opening the first maintenance cover are components with a relatively high average maintenance frequency and include at least the battery management unit board, the predetermined components on which maintenance is performed via the second maintenance opening by opening the second maintenance cover are components with a relatively medium average maintenance frequency and include at least the charging fuse, and the predetermined components on which maintenance is performed via the third maintenance opening by opening the third maintenance cover are components with a relatively low average maintenance frequency and include at least the cell management unit board.

4. The working vehicle according to claim 2, wherein the battery pack has the first maintenance opening formed in a plate surface of the second maintenance cover, the first maintenance cover is removably fixed to the plate surface of the second maintenance cover, and the third maintenance cover is disposed at a position that cannot be opened unless a counterweight fixed to the upper slewing body is removed.

5. The working vehicle according to claim 3, wherein the battery pack has the first maintenance opening formed in a plate surface of the second maintenance cover, the first maintenance cover is removably fixed to the plate surface of the second maintenance cover, and the third maintenance cover is disposed at a position that cannot be opened unless a counterweight fixed to the upper slewing body is removed.

6. The working vehicle according to claim 2, wherein out of the components to be maintained, the service plug is disposed at a position that is adjacent to the inlet in a left-right direction or an up-down direction.

7. The working vehicle according to claim 3, wherein out of the components to be maintained, the service plug is disposed at a position that is adjacent to the inlet in a left-right direction or an up-down direction.

8. The working vehicle according to claim 4, wherein out of the components to be maintained, the service plug is disposed at a position that is adjacent to the inlet in a left-right direction or an up-down direction.

9. The working vehicle according to claim 5, wherein out of the components to be maintained, the service plug is disposed at a position that is adjacent to the inlet in a left-right direction or an up-down direction.

* * * * *